United States Patent [19]

Neuroth

[11] Patent Number: 4,490,577

[45] **Date of Patent: * Dec. 25, 1984**

[54] ELECTRICAL CABLE FOR USE IN EXTREME ENVIRONMENTS

[75] Inventor: David H. Neuroth, Bethany, Conn.

[73] Assignee: Harvey Hubbell Incorporated, Orange, Conn.

[ * ] Notice: The portion of the term of this patent subsequent to Jun. 12, 2001 has been disclaimed.

[21] Appl. No.: 484,977

[22] Filed: Apr. 14, 1983

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F

[56] References Cited

U.S. PATENT DOCUMENTS

| | | | |
|---|---|---|---|
| 1,740,076 | 12/1929 | Delon | 174/103 |
| 1,927,845 | 9/1933 | Pheazey . | |
| 2,107,031 | 2/1938 | Evans | 165/170 X |
| 2,165,738 | 7/1939 | Van Hoffen | 174/105 R |
| 2,391,037 | 12/1945 | Shafer, Jr. | 174/102 SP |
| 2,483,301 | 9/1949 | Roberds | 174/15 |
| 2,544,233 | 3/1951 | Kennedy | 174/116 |
| 2,810,010 | 10/1957 | Davey | 174/88 |
| 2,897,253 | 7/1959 | Davey et al. | 174/70 |
| 3,102,740 | 9/1963 | Plummer | 156/256 X |
| 3,106,600 | 10/1963 | Crosby | 174/15 |
| 3,351,706 | 11/1967 | Gnerre et al. | 174/105 |
| 3,409,731 | 11/1968 | Fink et al. | 174/15 |
| 3,621,108 | 11/1971 | Cleaveland | 174/15 |
| 3,681,509 | 8/1972 | Johnston et al. | 174/16 B |
| 3,798,346 | 3/1974 | Kreuzer | 174/15 C |
| 3,843,568 | 10/1974 | Woodland et al. | 260/2.5 B |
| 3,988,526 | 10/1976 | Rasquin | 174/15 C |
| 4,105,860 | 8/1978 | Ball | 174/15 C |
| 4,110,554 | 8/1978 | Moore et al. | 174/101.5 |
| 4,123,585 | 10/1978 | Sparzak | 428/379 |
| 4,140,114 | 2/1979 | Moore et al. | 128/145 R |
| 4,166,920 | 9/1979 | Friedrich et al. | 174/15 C |
| 4,196,307 | 4/1980 | Moore et al. | 174/47 |
| 4,262,703 | 4/1981 | Moore et al. | 138/115 |
| 4,277,642 | 7/1981 | Piper et al. | 174/117 F |
| 4,282,398 | 8/1981 | Solomon | 174/106 R |
| 4,374,530 | 2/1983 | Walling | 174/47 X |
| 4,409,431 | 11/1983 | Neuroth | 174/117 F |

FOREIGN PATENT DOCUMENTS

| | | | |
|---|---|---|---|
| 1020074 | 11/1957 | Fed. Rep. of Germany . | |
| 834955 | 9/1938 | France . | |
| 335147 | 3/1930 | United Kingdom . | |
| 437525 | 10/1935 | United Kingdom . | |
| 699558 | 1/1953 | United Kingdom . | |
| 1242494 | 8/1971 | United Kingdom | 174/136 |
| 1250823 | 10/1971 | United Kingdom | 174/136 |
| 1387991 | 3/1975 | United Kingdom | 174/102 SP |
| 1387180 | 3/1975 | United Kingdom . | |
| 2069746 | 8/1981 | United Kingdom . | |

*Primary Examiner*—John Gonzales
*Assistant Examiner*—Morris H. Nimmo
*Attorney, Agent, or Firm*—Jerry M. Presson

[57] ABSTRACT

An armored electrical cable structure for resisting destruction and degradation of the conductor insulation, particularly on the outer conductors. The structure also provides the additional benefits of resisting decompression expansion of the conductor insulation, attack by corrosive agents as well as the conduction of heat from the interior parts of the cable structure to the cable exterior for dissipation.

18 Claims, 4 Drawing Figures

ELECTRICAL CABLE FOR USE IN EXTREME ENVIRONMENTS

This invention relates to a cable for use in extreme environments and more particularly, to a cable of flattened shape for supplying electrical power to submersible oil well pumps.

BACKGROUND OF THE INVENTION

Electrical cables which are used for supplying electrical energy to submersible oil well pumps are typically of flattened, cross-sectional shape and must be able to survive and perform satisfactorily under extremely adverse conditions of mechanical stress.

Such cables are subjected to mechanical stresses in several ways. It is common practice to fixedly attach the cables to the housing of the electrical submersible pump or oil well tubing by means of bands or straps which may crush the cables and thereby seriously degrade the quality of the insulation and the electrical integrity of the cable. The cables are also subject to impact damage during installation and high compression loads during and after installation. To resist these forces, it is conventional to apply an outer metal armor to the cable and to enclose the individual conductors with layers of materials chosen to enhance their strength characteristics. Such measures are sometimes not adequate to provide the necessary insulation protection, especially against edge impacts and edge abrasion.

An additional problem arises as a result of down-hole pressures, which can be in the hundreds or thousands of pounds per square inch, to which the cables are subjected. Typically, the insulation surrounding the conductors in a cable contains micropores into which gas is forced at these high pressures over a period of time. Then, when the cable is rather quickly extracted from the wall, or the pressures applied to the cable by the column of fluid in the wall bore change dramatically due to intermittent operation of the pump powered by the cable, there is insufficient time for the intrapore pressure to bleed off. As a result of repeated decompressions, the insulation tends to expand and contract and can rupture rendering the cable weakened or useless.

In my copending U.S. patent application Ser. No. 291,125 filed Aug. 7, 1982, and assigned to the same assignee as the instant invention, there is described a cable structure which is particularly suitable for use in such extremely adverse environments. The structure protects the cable against inwardly-directed compressive forces and provides for the dissipation of heat from the cable interior to the surrounding environment which is an important feature in high temperature operating environments, for reasons discussed therein, as well as resistance to decompression expansion of the insulation.

As described in said copending application Ser. No. 291,125, the cable protective structure includes one or more elongated force-resisting members which extend parallel and adjacent an insulated conductor of the cable. The members are rigid in cross-section to resist compressive forces which would otherwise be borne by the cable conductors. For applications requiring the cable to undergo long-radius bends in service, the elongated member may be formed with a row of spaced-apart slots which extend perpendicularly from the one edge of the member into its body to reduce the cross-sectional rigidity of the member in the slotted areas so as to provide flexibility in the support to large-radius bending about its longitudinal axis.

As described in my copending patent application Ser. No. 390,308 filed June 21, 1982 and assigned to the same assignee as the present invention, for certain service applications, it may be preferred that the electrical insulating sheath on the cable conductor not be in direct contact with the slot openings. This is because the slot openings in the support member may allow highly corrosive materials to gain access to the jacket composition by flowing inwardly through the slots. In addition, the sharp corner edges formed by slotting may cut into or abrade the underlying cable jacket upon repeated flexing of the cable.

The cable protective structure of said copending application Ser. No. 390,308 is made of a composite structure which utilizes an elongated force-resisting member of good thermal conductivity positioned adjacent the insulating conductor sheath. This member comprises a channel member of U-cross-sectional shape. A smooth, bendable liner may be mounted within the channel facing the insulation of the adjacent conductor to bridge the slots in the member and thereby protect the underlying insulation from abrasion by the slot edges during bending of the channel member.

The exterior jacket or armor, the liners and the channel members all serve to protect the conductor insulation, and hence the cable, from damage caused by compression forces, impacts and decompression expansion.

Supplementary resistance to compressive forces may be obtained with a cable constructed in accordance with my copending application Ser. Nos. 429,530 and 429,781, filed on Sept. 30, 1982 and assigned to the same assignee as the instant invention.

For certain service applications and particularly oil well applications, the cable must be able to be axially inserted and withdrawn through an open space formed between the interior circular wall of the well casing and the exterior surface of the oil well tubing, electric submersible pump housing or other structure to which the cable is affixed. Typically, the cable is mounted on the exterior surface of a centrifugal pump and hence, extends outwardly of the pump housing thereby posing a potential obstruction to a proper fit in the oil well casing. Furthermore, it follows that the thicker the cable in cross-section, the smaller the cross-sectional dimension that the pump must have for both to fit into an oil well casing of a given cross-sectional size. Electrically-powered centrifugal pumps, however, are typically much more efficient in larger diameters, and thus, it is preferred that the cross-sectional thickness of the associated cable be made as small as possible so that the user can employ the most efficient pump. Since these structures are typically cylindrical, the open space between them is essentially annular in cross-section, being defined by two essentially circular surfaces of different radii.

As mentioned above, for these applications, the cable is subject to very high temperatures and pressures, severe compressive forces in the well and impacts during installation from, for example, hammers or other tools. Hence, it is desirable to use the cables disclosed in my aforementioned patent applications and yet, it is also desirable to minimize the effective thickness of the cable and thus, the possibility that the cable will jam or lodge against the well casing during the insertion or withdrawal of the equipment on which the cable is mounted.

As described in my copending patent application Ser. No. 447,969 filed Dec. 8, 1982 and assigned to the same assignee as the instant invention, armored cable for oil well applications may have an arcuate cross-sectional shape which conforms to the curvature of the surface on which it is mounted. This reduces the effective thickness of the cable by conforming to, and taking maximum advantage of, the annular space available between the wall of the well casing and the outer cylindrical surface of the underlying pump housing or tubing. While this arcuate construction reduces the profile of the cable edges to abrasion and edge impacts under extreme usage conditions, the outside edges of the cable and hence, the insulation on the outside conductors may nonetheless receive destructive edge impacts as well as structural degradation resulting from abrading against the wall of the well casing.

The instant invention discloses an armored electrical cable structure which is especially constructed to resist destruction and degradation of the conductor insulation on the outer conductors resulting from impacts and edge wear caused by abrasion. The structure also provides the additional benefits of resisting decompression expansion of the conductor insulation, attack by corrosive agents as well as the conduction of heat from the interior parts of the cable structure to the cable exterior for dissipation.

OBJECTS OF THE INVENTION

An object of this invention is to provide an improved electrical flat cable having reinforced edges for resisting edge impacts and abrasion encountered in extremely adverse environments, such as oil wells.

Yet another object of this invention is to provide a flattened armored electrical cable structure of substantially rectangular cross-sectional shape incorporating means for resisting edge impacts and abrasion encountered in adverse environments.

Other objects, advantages and salient features of the present invention will become apparent from the following detailed description which, taken in conjunction with the annexed drawings, discloses a preferred embodiment of the invention.

DETAILED DESCRIPTION OF THE INVENTION

Figure 1:
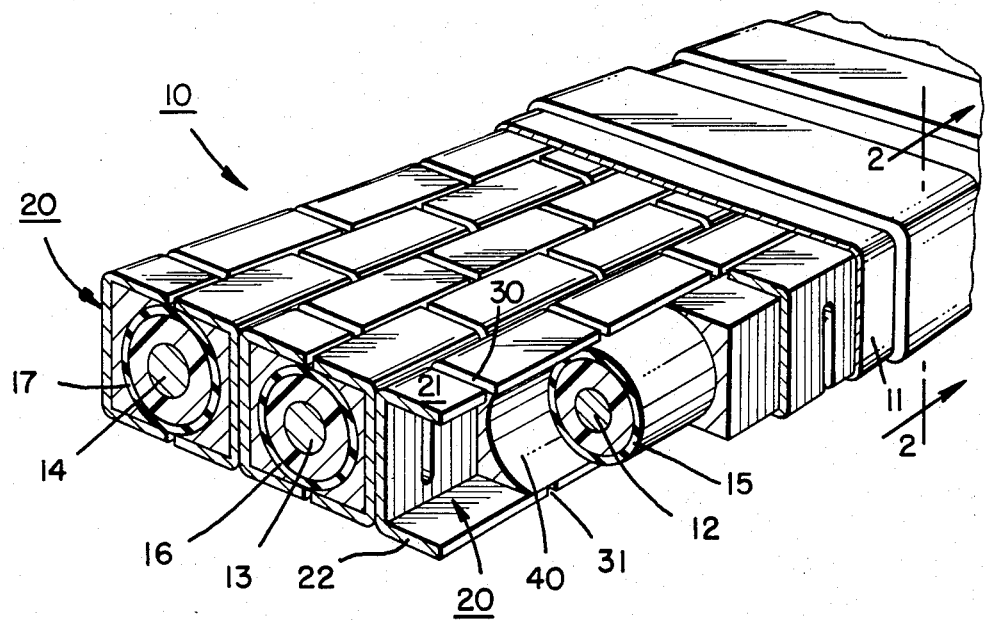
FIG. 1 is a partial perspective sectional view of a length of flattened cable constructed in accordance with this invention, the extremity of the cable being shown with an outer protective jacket removed.

FIG. 1 illustrates one embodiment of an armored cable 10 of flattened cross-section constructed in accordance with the present invention which is particularly suitable for use in severe adverse environments such as encountered in oil wells. The cable 10 includes a metal protective jacket or armor 11 which surrounds and encloses a plurality of individually insulated, spaced-apart wires or conductors 12, 13 and 14.

For these severe usage applications, the cable must be able to be axially inserted and withdrawn through an open area formed between the interior circular wall of the well casing and the exterior surface of the oil well tubing, electric submersible pump housing or other structure to which the cable is affixed. Since these structures typically have arcuate surfaces and more particularly, cylindrical surfaces, the open space is essentially annular in cross-section because it is defined by two cylindrical surfaces of different radii.

Figure 3:
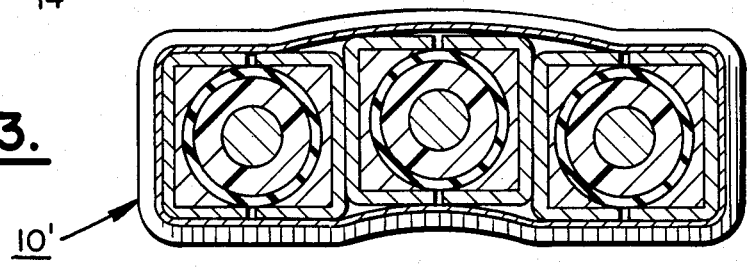
FIG. 3 is an end sectional view of the instant cable having a center region thereof bent into an arcuate configuration.

As mentioned above, for these applications, the cable is usually subject to very high temperatures and pressures, to very severe compressive and decompressive forces and may be subjected to edge impacts by hammers or other tools. In addition, the outer edges of the cable can contact the wall of the oil well casing during the insertion and withdrawal of the cable. Such conduct can abrade the cable edges and cause the armor to weaken or fail in these regions of the structure. To provide the cable with a slightly arcuate cross-sectional configuration, as shown by FIG. 3, to facilitate its longitudinal movement through the annular space between the well casing and the structure to which the cable is strapped, the conductors may be arranged so that their central axes lie in an arcuate plane parallel to the plane of the cylindrical surface of the structure (not shown) against which the cable is mounted. Such a structure could be the housing of an oil well pump, the electrical motor for driving the pump, the cylindrical oil well piping leading from the pump to the surface, or any other structure having a substantially cylindrical surface upon which the cable is to be mounted.

The jacket 11 is typically formed of steel band or tape of Z-cross-sectional shape which is wrapped about the conductors 12, 13 and 14 in overlapping helical fashion to form an interlocked armored sheath. The juxtaposed conductors are of considerable length, as needed, it being understood that only a very short length of the cable is illustrated in FIG. 1. The conductors 12, 13 and 14 are each covered by one or more layers of electrical insulation and/or other protective coverings; two such layers being illustrated and referred to by the numerals 15, 16 and 17, respectively.

As will be recognized, the insulation (or other coverings) on these conductors is more than simply one or more layers of chemical barrier and/or electrically insulative material. Normally, in an environment such as an oil well, a pump cable would include the insulation which is a system of layers of insulated materials of different types to provide the desired electrical dielectric properties as well as resistance to various chemical reactions which occur with accelerated chemical activity in these high temperature and pressure environments as well as decompression forces. For down-hole applications, the conductors are arranged so that the central axes of the conductors lie parallel and in essentially the same flat or arcuate plane providing the cable with a preferred flattened shape.

The three insulated conductors are each spaced laterally from one another far enough to provide a lateral space therebetween which will accommodate three pairs of force-resisting channel members 20. Each of the members 20 are also elongated and extend parallel with the conductors and two members 20 of each pair face one another to essentially enclose a conductor therebetween. Members 20 are made of a material which is substantially rigid in cross-section and which is selected to have good thermal conductivity properties, i.e., a thermal conductivity which is at least, and preferably substantially greater than the thermal conductivity of the underlying conductor insulation. Fiber-filled carbon compositions are suitable for this purpose, and also exhibit good compression resistance. Metals such as steel or aluminum are also suitable for this purpose, as are metal-filled curable polymeric materials which may be extruded.

While the cable shown in the drawing has three electrical power conductors, it will be apparent that they could contain a different number. In accordance with this invention, the number of pairs of force-resisting members 20 is equal to the number of conductors or other tubular members which may be embodied in the cable.

Each member 20 may be punched from a single, continuous strip of U-shape channel material and hence, each length of channel 20 will be of substantially identical U-cross-sectional size and shape formed by upper and lower legs 21 and 22, respectively, which are substantially flat, parallel and horizontal as viewed in FIG. 20 so that they conform to the respective upper and lower flat surfaces of the metallic jacket 11. The lateral legs 21 and 22, respectively, of each member are joined by a rigid, vertical leg 23 which is slightly longer than the overall diameter of the conductor and its covering layer or layers of insulation.

The legs 21 and 22 extend in the same direction at right angles to the leg 23 approximately to the center of the adjacent conductor which faces the open side of the channel. Hence, the legs 21 and 22 extend from the joining leg 23 to each side of this conductor a distance which is about equal to the maximum radius of the conductor plus its insulation covering or coverings. Crushing forces applied to the cable jacket 11, especially in directions perpendicular to the longitudinal axis of the cable 10, will be resisted by the channels 20 which are rigid in cross-section and damage to the conductor insulation by such forces will thereby be prevented or at least minimized.

The members 20, while quite rigid and resistant to compression in directions perpendicular to the longitudinal axis of the cable 10, should also have a degree of bidirectional flexibility allowing the cable to undergo long-radius bends as necessary when installing the cable in a service location. This can be provided by a first row of slots 30 extending inwardly through each of the upper channel legs 21 and perpendicularly through the joining leg 23 and terminating approximately at the right angle bend where the leg 23 joins the opposite leg 22. The slots 30 are substantially uniformly spaced apart in the longitudinal direction of the channel and thereby divide the channel 20 into a succession of individual, flexibly interconnected channel segments. Longitudinally and alternately spaced between slots 30 is a second and opposite row of slots 31 which extend perpendicularly into the body of each channel 20 from the lower leg 22 through the right angle bend where the leg 21 meets the leg 23 to a point midway to the leg 23. Slots 31 are also substantially uniformly spaced apart in the longitudinal direction, and lie approximately midway between slots 30. Thus, the slots 30 and 31 extend inwardly alternately from the legs 21 and 22, respectively, and impart greater bidirectional flexibility in the members 20 in the major plane of cable bending; that is, in a plane perpendicular to the plane passing through the centers of the juxtaposed conductors 12, 13 and 14. When installed in a cable, the resulting channel structure 20 of alternately, flexibly interconnected channel segments would be similar in appearance to that shown in FIG. 1.

Although the slots provide channel flexibility, the sharp edges formed in the channels 20 by the slots might abrade the electrical insulation 15, 16 and 17 on the respective cable conductors 12, 13 and 14 which are at least partially surrounded by the members 20 upon the repeated bending of these members.

To prevent such abrasion, an elongated liner 40 is inserted into the U of each channel. The liners 40 have substantially flat, opposite surfaces abutting and coextensive with the inner surfaces of legs 21, 22 and 23, FIGS. 1 and 2. A semi-circular concave surface on each liner conforms to the semi-circular, outermost insulating layer or covering on an adjacent conductor. Each liner 40 is made sufficiently continuous to bridge the inner corners and edges formed by the slots 30 and 31, thereby spacing these edges from direct contact with the insulation on the underlying conductor core.

The protective liners 40 are preferably somewhat flexible so as to bend through arcs simultaneously with its overlying channel 20 in directions substantially perpendicular to the major bending plane or longitudinal axis of the cable 10. For oil well applications, the liners 40 are preferably composed of a material having good thermal conductivity to dissipate the heat applied to the cable 10 in such environments. The liner material should be relatively smooth to slide on the outermost insulation, especially during bending of the latter. A suitable metallic material for the liners is lead, which has a smooth surface for facilitating sliding upon electrical insulation and yet provides good thermal conductivity. Other suitable metallic or nonmetallic materials may also be used for the liners. The liners also afford a measure of protection to the insulation of the conductors against contact with, and possible attack by, insulation-degrading and corrosive chemicals.

The liners 40 may be fixedly mounted in their respective channels 20 by merely dimpling, semi-piercing or coining inwardly small surface areas on the opposite legs 21 and 22 of the members 20 to form inwardly projecting protuberances or barbs (not shown) which cooperate to hold the liners 40 in associated channels with their concave surfaces facing opposite halves of the conductor insulation.

Figure 2:
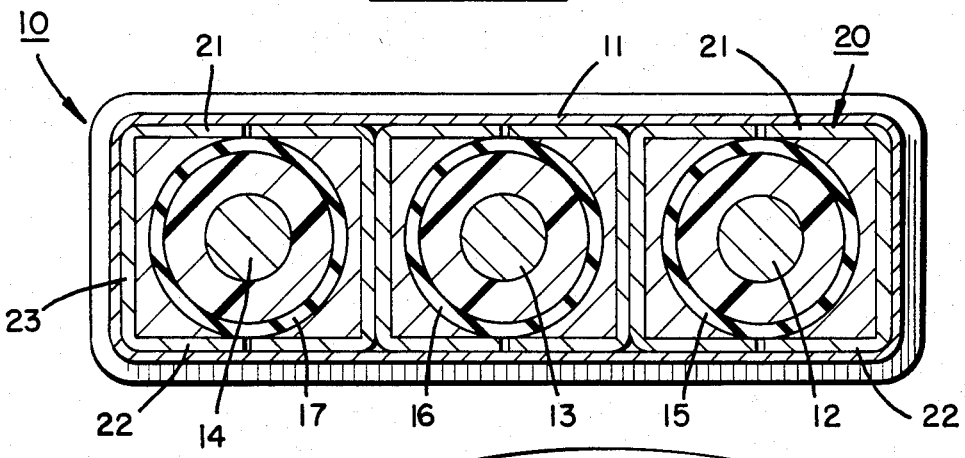
FIG. 2 is an end sectional view of the cable taken along section line 2-2 of FIG. 1, illustrating a pair of protective members for protecting the electrical insulation of the outermost cable conductors against edge impacts and abrasion.

In accordance with this invention, the outermost halves of the insulation on the two outer conductors 12 and 14 are also protected by a member 20 such that each outer conductor half is substantially entirely enclosed by a member 20 and the entire insulation is protected by a pair of oppositely facing, substantially abutting members 20, as shown in FIG. 2. This protection for the outer insulated conductors 12 and 14 is essential for cables subject to severe edge impacts and abrasion which might cause penetration or breakage of the armor 11 and tearage or other disruption of the insulation layers 15 or 17. With U channel members positioned along each outer cable edge, the flat leg sections 23 define the outer edges of the cable protective structure sheathed by the armor jacket 11. To properly sheath and minimize the cross-sectional area of the cable, the protective structure and the armor should conform and lie closely to the rectangular cross-section of the protective structure. This requires that during the cable forming operation, the opposite edges of the armor 11 be bent sharply at substantially right angles to the adjoining, substantially parallel sides of the cable so as to closely overlie and restrict movement of the flat sections 23 of the members 20. As a result, the cable 10 is substantially rectangular in cross-section with its armored edges at substantially right angles to the flat cable surfaces. The layers of armor and the corners of the member 20 protect the underlying insulation layers 15 and 17, as best seen in FIGS. 2 and 3, and tend to dissipate therebetween edge impact forces. As a result of this construction, the edge impact resistance of the instant cable is typically at least three times greater than that of the cables disclosed in my aforementioned applications wherein edge channel members were omitted to allow curvature to each cable edge. In addition, the thermal conductivity of the instant cable 10 is increased because the thermally conductive other members 20 at the respective outer cable edges provide a greater heat path for conducting heat from the cable interior. Further, with the opposing pairs of members 20 around each conductor in juxtaposed abutting relationship, all of the insulated conductors are completely and tightly boxed in together resulting in the cable having improved resistance against compression and impacts in planes which are radial to the conductors.

Figure 4:
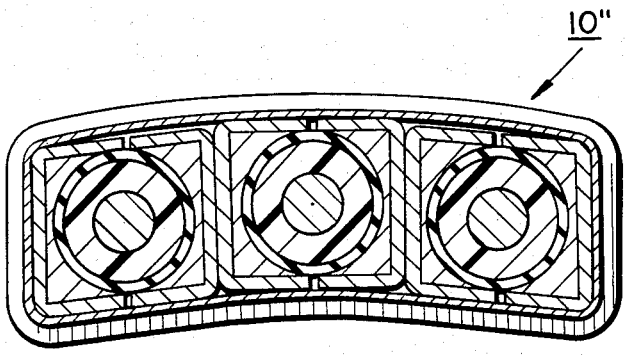
FIG. 4 is an end sectional view of a fully arcuate cable in accordance with this invention.

As best seen in FIG. 3, with each conductor boxed in by an opposing pair of force-resisting members 20, an arcuate cross-sectional shape to the central part of the cable is achieved by slightly offsetting the central axis of the central conductor with respect to the central axes of the two outer conductors. Thus, the central axes of the three juxtaposed conductors will not be coplanar but rather will lie on a locus of curvature which is substantially parallel to the curvature of the surface upon which the cable is to be placed. Inasmuch as the sheathing which is wrapped around the juxtaposed members 20 is typically composed of a rigid metal, the desired arcuate cross-sectional shape may be obtained by passing the cable structure through a pair of coacting conventional metal forming rollers of appropriate curvature, while the central conductor is retained in the depicted offset position relative to the two outer conductors. While FIG. 3 depicts an arcuate cross-section which is of limited extent, resulting from the bending accorded the structure by one pair of forming rollers, FIG. 4 illustrates a cable 10″ made arcuate throughout its entire cross-section by passage through two or more pairs of progressively proportioned forming rollers so that the cable will conform, for example, to the surface of a motor pump or drill pipe. With its flat edges, the cable 10″ has a cross-section which is essentially that of a parallelogram. Once the desired cross-sectional curvature is given to the cable structure, the sheathing retains the boxed-in conductors in the respective positions depicted in FIGS. 3 and 4.

While certain various advantageous embodiments have been chosen to illustrate the invention, it will be understood by those skilled in the art that various changes and modifications can be made therein without departing from the scope of the invention as defined in the appended claims.

What is claimed is:

1. An electrical cable structure having substantially flat, opposite sides and opposite edges, comprising:

a plurality of elongated, individually insulated electrical conductors of circular cross-section, each of said conductors having a concentric layer of insulation thereon and a longitudinal axis, the longitudinal axes being in substantially parallel relationship to one another, the outermost ones of said conductors located inwardly adjacent a different one of the two edges and having their longitudinal axes contained in one plane with a longitudinal section of insulation on each of said outermost ones of said conductors facing a different, opposite one of said two edges;

a first pair of discrete, elongated members, each of said members having a longitudinal axis and a rigid cross-section transverse to said one plane and having a greater resistance to transverse compressive forces than that of the insulation layers on the outermost ones of said conductors;

the longitudinal axes of said members contained in a second plane which is substantially parallel to said one plane;

each of said members being flexible for long-radius bending along the longitudinal axis thereof in directions substantially perpendicular to said second plane; and a protective jacket around the insulated conductors and said members;

each of said members having a longitudinal portion thereof extending substantially parallel to and adjacent each said longitudinal section of insulation on an outermost one of said conductors, each of the member portions having an inner surface which is arcuate in its transverse cross-section for surrounding a longitudinal section of insulation, thereby restraining decompressive expansion of such insulation section;

each of said member portions having a substantially planar outer surface extending substantially perpendicular to said one plane between the sides of the structure at least coextensively with the longitudinal section of insulation on the conductor adjacent thereto, each of said outer surfaces of said member portions positioned in the structure intermediate an outermost one of said conductors and each adjacent edge of the structure for protecting the longitudinal sections of insulation on the outermost conductors from edge impacts.

2. The electrical cable according to claim 1 wherein said elongated members are composed of a material having greater thermal conductivity than that of the conductor insulation.

3. The cable according to claim 2 wherein the portions of said members are of rectangular cross-section.

4. The cable structure according to claim 3 wherein each of said members are formed of a rigid channel of substantially U cross-sectional shape.

5. The electrical cable according to claim 4 wherein the region between the open side of the "U" of each of said channels and the insulation part of each of said conductors contain a liner, each said liner having a transverse cross-section conforming to the surface of the insulation part to restrain the insulation against decompression expansion.

6. The cable structure according to claim 1 wherein said jacket forms the sides and edges of said cable.

7. The cable structure according to claim 6 wherein there is a second pair of the U-shaped members, each member of said second pair positioned adjacent the insulation on said conductors opposite the insulation facing a different member of said first pair with the open sides of the respective members of said first and second pairs in mutually facing relationship.

8. The cable structure according to claim 7, wherein portions of said both sides of the cable structure are substantially parallel in transverse cross-section and wherein said one side of the cable structure joins one of said cable edges at substantially right angles in transverse cross-section.

9. The cable structure according to claim 8, wherein each said opposite side of the cable structure joins a said edge at substantially right angles in transverse cross-section.

10. The cable structure according to claim 9, wherein said jacket is an armor jacket.

11. The cable structure according to claim 10, wherein the armor jacket comprises a metal tape with overlapping edges.

12. An improved electrical cable having a longitudinal axis and a cross-section transverse to said axis which is substantially flat, comprising:

two elongated electrical conductors of substantially circular cross-section having longitudinal axes in substantially parallel relationship to another and to the longitudinal axis of the cable, the longitudinal axes of said conductors contained in a first plane;

a layer of electrical insulation disposed concentric on each of said conductors;

each of said conductors with a layer of insulation thereon located inwardly of and adjacent to a different opposite edge of said cable with a longitudinal section of the insulation layer on each conductor facing outwardly toward its most adjacent cable edge;

a pair of elongated members having longitudinal axes extending substantially parallel to the longitudinal axes of said conductors and contained in a second plane which is substantially parallel to said first plane; and a protective jacket encasing said conductors and said members;

each of said members mounted between the jacket and the section of insulation on one of said conductors;

said members being flexible for long radius bending along the longitudinal axis thereof in directions substantially perpendicular to said second plane and being rigid in a plane transverse to said second plane;

each of said members comprised of an inner longitudinal edge portion facing one said longitudinal section of insulation layer, said inner edge portion being arcuate in transverse cross-section to surround said section of insulation that said inner edge portion faces, whereby decompressive expansion of the insulation is restrained, each of said members having a longitudinally extending outer edge portion which is angular in said transverse plane for providing a rigid, angular corner to the corresponding cable edge for resisting edge impacts.

13. The cable according to claim 12, and further comprising, a third member intermediate said conductors for resisting decompressive expansion and transverse compression of the insulation.

14. The cable according to claim 12 wherein said jacket is comprised of a metal tape wrapped tightly against the outer edges of said members.

15. The cable according to claim 13, wherein said first and second planes are substantially coplanar.

16. The cable according to claim 15, wherein said members are mounted in the cable with outer edge surfaces thereof lying in substantially parallel planes, said planes being substantially perpendicular to said second plane containing the longitudinal axes of said members, whereby the opposite edges of the cable are substantially planar and substantially parallel to one another.

17. The cable according to claims 13 or 16, wherein a third elongated member, having a longitudinal axis parallel to the longitudinal axes of said members, is mounted between said pair of elongated members with its longitudinal axis offset laterally from said second plane containing said longitudinal axes of said members, whereby the cable is inflected in said transverse plane.

18. The cable according to claim 12, wherein said members are of unitary cross-section.

* * * * *